US009310082B2

(12) United States Patent
Kraemer

(10) Patent No.: US 9,310,082 B2
(45) Date of Patent: Apr. 12, 2016

(54) RICH BURN, QUICK MIX, LEAN BURN COMBUSTOR

(71) Applicant: General Electric Company, Schenectady, NY (US)

(72) Inventor: Gilbert Otto Kraemer, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 556 days.

(21) Appl. No.: 13/777,179

(22) Filed: Feb. 26, 2013

(65) Prior Publication Data

US 2014/0238024 A1 Aug. 28, 2014

(51) Int. Cl.
*F23R 3/14* (2006.01)
*F23R 3/34* (2006.01)

(52) U.S. Cl.
CPC .. *F23R 3/346* (2013.01); *F23R 3/14* (2013.01)

(58) Field of Classification Search
CPC ..... F23R 3/346; F23R 3/14
USPC ..... 60/732, 733, 746, 748
See application file for complete search history.

(56) References Cited

U.S. PATENT DOCUMENTS 4,787,208 A 11/1988 DeCorso
4,845,940 A * 7/1989 Beer ..... F23C 6/045 60/732
5,321,948 A * 6/1994 Leonard ..... F23R 3/08 60/737
5,647,215 A * 7/1997 Sharifi ..... F23D 17/002 60/746
5,950,417 A * 9/1999 Robertson, Jr. ..... F23C 6/045 60/733
6,298,654 B1 * 10/2001 Vermes ..... F02C 6/006 60/39.41
6,354,072 B1 3/2002 Hura
6,735,949 B1 5/2004 Haynes et al.
6,951,108 B2 10/2005 Burrus et al.
7,003,961 B2 2/2006 Kendrick et al.
2004/0020211 A1 2/2004 Kendrick et al.
2006/0260316 A1 * 11/2006 Stuttaford ..... F23D 14/82 60/737
2010/0218504 A1 9/2010 Bronson et al.
2011/0016867 A1 * 1/2011 Milosavljevic ..... F23R 3/286 60/737
2011/0041508 A1 2/2011 Karlsson et al.
2011/0061391 A1 3/2011 Kendrick

* cited by examiner

*Primary Examiner* — Ted Kim
(74) *Attorney, Agent, or Firm* — Dority & Manning, PA

(57) ABSTRACT

A combustor for a gas turbine includes a fuel nozzle having a central swirler that circumferentially surrounds a downstream end of the fuel nozzle. A primary combustion zone is defined within the central swirler. The combustor further includes an outer swirler that circumferentially surrounds at least a portion of the central swirler and a venturi that is disposed downstream from the primary combustion zone. The venturi includes an inner surface. The central swirler imparts angular swirl to a compressed working fluid so as to rapidly mix and react the fuel rich primary zone products with the working fluid. The outer swirler imparts angular swirl to a compressed working fluid so as to provide a cooling boundary layer along the inner surface of the venturi.

19 Claims, 5 Drawing Sheets

RICH BURN, QUICK MIX, LEAN BURN COMBUSTOR

FIELD OF THE INVENTION

The present invention generally involves a combustor for a gas turbine. More specifically, the invention relates to a rich burn, quick mix and lean burn combustor.

BACKGROUND OF THE INVENTION

A combustion section of a gas turbine generally includes a plurality of combustors that are arranged in an annular array around an outer casing such as a compressor discharge casing. Pressurized air flows from a compressor to the compressor discharge casing and is routed to each combustor. Fuel from a fuel nozzle is mixed with the pressurized air in each combustor to form a combustible mixture within a primary combustion zone of the combustor. The combustible mixture is burned to produce hot combustion gases having a high pressure and high velocity. The combustion gases are routed through the combustor and into a turbine of the gas turbine. Thermal and kinetic energy are transferred from the combustion gases to various stages of rotatable blades coupled to a rotor shaft, thereby causing the rotor shaft to rotate. The rotating shaft produces mechanical work. For example, the rotor shaft may be coupled to a generator to produce electricity.

Various factors influence the design and operation of the combustors. For example, higher combustion gas temperatures generally improve the thermodynamic efficiency of the combustors. However, higher combustion gas temperatures generally increase the disassociation rate of diatomic nitrogen, thus increasing the production of nitrogen oxides ($NO_X$). In addition, gas turbine operators may prefer to use different types of fuels depending upon availability and price. However, various fuels such as liquefied natural gas and heavy fuel oil may have a high level of fuel bound nitrogen, thereby resulting in high levels of NOx emissions when the combustion gases are above certain combustion temperatures. As a result, such fuels generally require the use of selective catalytic reduction (SCR) and/or other processes in order to reduce the level of NOx emissions. However, the use of SCR and/or other processes required to reduce the undesirable NOx levels add to the overall operating costs and the overall complexity of the gas turbine engine.

Another approach to reduce NOx production from fuel bound nitrogen is a combustor having a rich-burn combustion zone, a quick-mix or quick-quench zone that is downstream from the rich-burn combustion zone, and a lean-burn combustion zone that is downstream from the quick-quench zone. This combustion technology is commonly known as a Rich-Burn, Quick-Quench and Lean-Burn (RQL) combustion system. The RQL combustor may be used in conjunction with the SCR. In large part, the effectiveness of the RQL combustor is primarily dependent on the design of the venturi of the quick-quench zone of the RQL combustor. Therefore, an improved RQL combustor, in particular an improved quick-quench zone for an RQL combustor would be useful in the industry.

BRIEF DESCRIPTION OF THE INVENTION

Aspects and advantages of the invention are set forth below in the following description, or may be obvious from the description, or may be learned through practice of the invention.

One embodiment of the present invention is a combustor for a gas turbine. The combustor includes a fuel nozzle and a central swirler that circumferentially surrounds a downstream end of the fuel nozzle. The combustor further includes a primary combustion zone that is defined within the central swirler wherein the fuel and working fluid are rapidly mixed and combusted. An outer swirler circumferentially surrounds at least a portion of the central swirler and a venturi is disposed downstream from the primary combustion zone. The venturi includes an inner surface. The central swirler imparts angular swirl to a compressed working fluid to react with a fuel rich mixture from the primary combustion zone and the outer swirler imparts angular swirl to a compressed working fluid to provide a cooling boundary layer along the inner surface of the venturi.

The central swirler imparts angular swirl to a compressed working fluid so as to assist in atomizing liquid fuel droplets from the primary combustion zone and the outer swirler imparts angular swirl to a compressed working fluid so as to provide a cooling boundary layer along the inner surface of the venturi and support lean combustion downstream.

Another embodiment of the present invention is a combustor for gas turbine. The combustor includes a central swirler that defines a primary combustion zone within the combustor and that imparts angular swirl to a working fluid flowing through the central swirler to provide a swirling quench air flow downstream from the primary combustion zone. The combustor further includes an outer swirler that surrounds the central swirler. The outer swirler imparts angular swirl to a working fluid flowing through the outer swirler to provide a swirling cooling air flow that surrounds the quench air flow. A venturi in fluid communication with the central swirler and the outer swirler is disposed downstream from the primary combustion zone. The venturi includes an inner surface. The outer swirler provides a cooling boundary layer of the swirling cooling air flow along the inner surface of the venturi.

The present invention may also include a gas turbine. The gas turbine generally includes a compressor, a combustor downstream from the compressor and a turbine disposed downstream from the combustor. The combustor comprises an end cover that is coupled to an outer casing. The outer casing surrounds the combustor. A fuel nozzle having a downstream end extends downstream from the end cover. A central swirler surrounds the downstream end of the fuel nozzle and imparts angular swirl to a working fluid flowing through the central swirler so as to provide a swirling quench air flow downstream from the primary combustion zone. An outer swirler surrounds the central swirler and imparts angular swirl to a working fluid flowing through the outer swirler to provide a swirling cooling air flow that surrounds the quench air flow. A venturi is disposed downstream from the primary combustion zone and is in fluid communication with the central swirler and the outer swirler. The outer swirler provides a cooling boundary layer of the swirling cooling air flow along the inner surface of the venturi.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
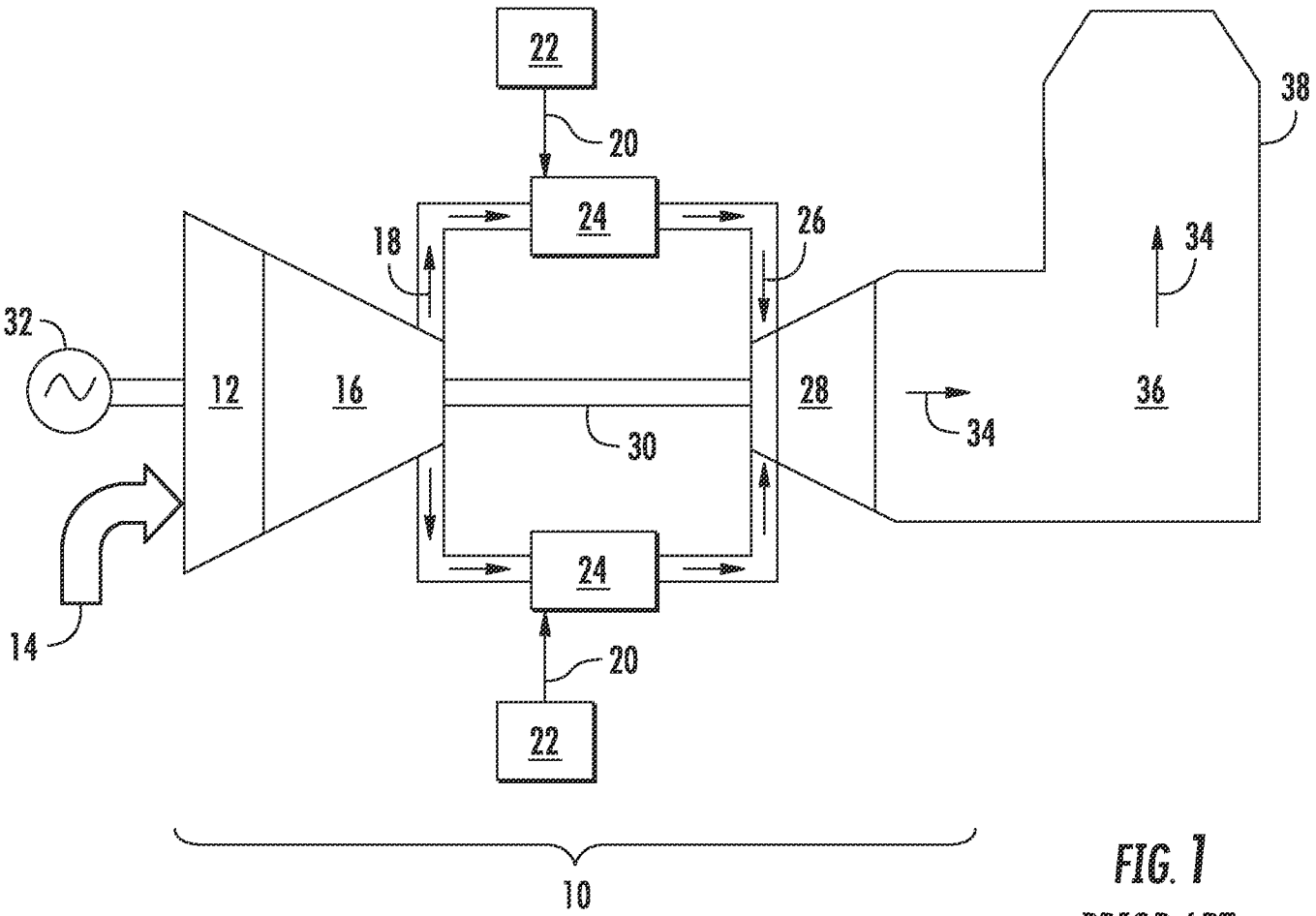
FIG. 1 PRIOR ART
FIG. 1 is a functional block diagram of an exemplary gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel to an axial centerline of a particular component.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although exemplary embodiments of the present invention will be described generally in the context of a combustor incorporated into a gas turbine for purposes of illustration, one of ordinary skill in the art will readily appreciate that embodiments of the present invention may be applied to any combustor incorporated into any turbomachine and is not limited to a gas turbine combustor unless specifically recited in the claims.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor section where a compressor 16 progressively imparts kinetic energy to the working fluid 14 to produce a compressed working fluid 18 at a highly energized state.

The compressed working fluid 18 is mixed with a fuel 20 from a fuel supply 22 to form a combustible mixture within one or more combustors 24. The combustible mixture is burned to provide a flow of combustion gases 26. The combustion gases 26 flow through a turbine 28 of a turbine section to produce work. For example, the turbine 28 may be connected to a shaft 30 so that rotation of the turbine 28 drives the compressor 16 to produce the compressed working fluid 18. Alternately or in addition, the shaft 30 may connect the turbine 28 to a generator 32 for producing electricity. Exhaust gases 34 from the turbine 28 flow through an exhaust section 36 that connects the turbine 28 to an exhaust stack 38 downstream from the turbine 28. The exhaust section 36 may include, for example, a heat recovery steam generator (not shown) for cleaning and extracting additional heat from the exhaust gases 34 prior to release to the environment.

Figure 2:
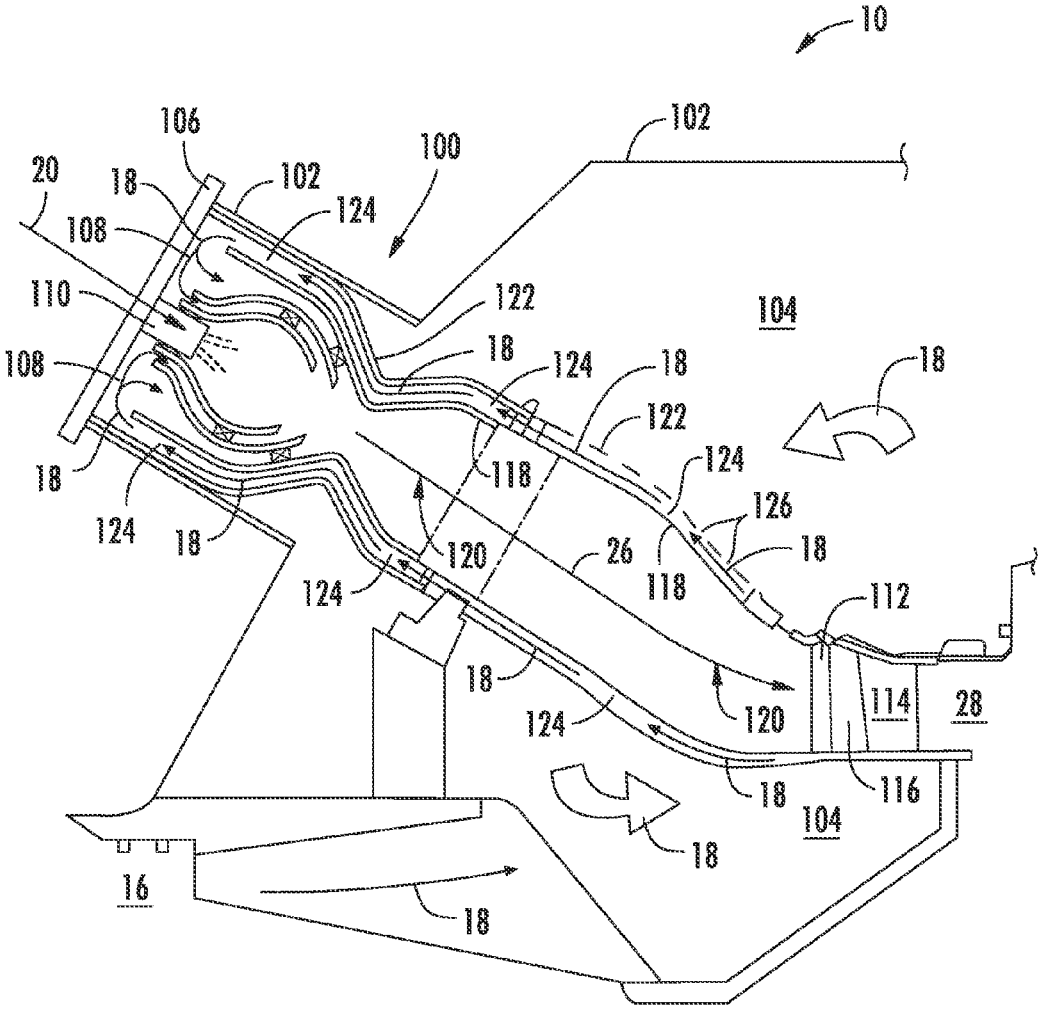
FIG. 2 is a cross sectional side view of an exemplary gas turbine as described in FIG. 1, according to one embodiment of the present invention.

FIG. 2 provides a cross sectional side view of a portion of the gas turbine 10 as shown in FIG. 1 and as described above, including a combustor 100 according to at least one embodiment of the present disclosure. As shown, the combustor 100 is at least partially surrounded by an outer casing 102 such as a compressor discharge casing that is in fluid communication with the compressor 16. The outer casing 102 at least partially defines a high pressure plenum 104 that surrounds at least a portion of the combustor 100. A radially extending end cover 106 is coupled to the outer casing 102 at a head end 108 of the combustor. A fuel nozzle 110 extends generally axially downstream from the end cover 106. The combustor 100 generally terminates at an aft end 112 that is disposed adjacent to a first stage of stationary nozzles 114 that at least partially define an inlet 116 to the turbine 28.

One or more annular liners or ducts 118 extend at least partially between the head end 110 and the aft end 112 of the combustor 100 to at least partially define a hot gas path 120 within the combustor 100 for routing the combustion gases 26 into the inlet 116 of the turbine 28. One or more annular flow sleeves 122 may at least partially surround the one or more liners 118. The one or more flow sleeves 122 are radially separated from the one or more liners 118 so as to define a cooling flow passage 124 therebetween. Each or some of the one or more flow sleeves 122 may include a plurality of impingement cooling holes 126 that provide for fluid communication between the high pressure plenum 104 and the cooling flow passage 124 during operation of the gas turbine 10.

In operation, the compressed working fluid 18 enters the high pressure plenum 104 form the compressor 16. At least a portion of the compressed working fluid 18 flows through the impingement cooling holes 126 and into the cooling flow passage 124 where it is routed towards the head end 110 of the combustor 100. The compressed working fluid 18 provides at least one of impingement cooling or convective cooling to an outer surface of the one or more liners 118 before reaching the head end 108 and reversing flow direction at the end cover 106 and/or the head end 108.

Figure 3:
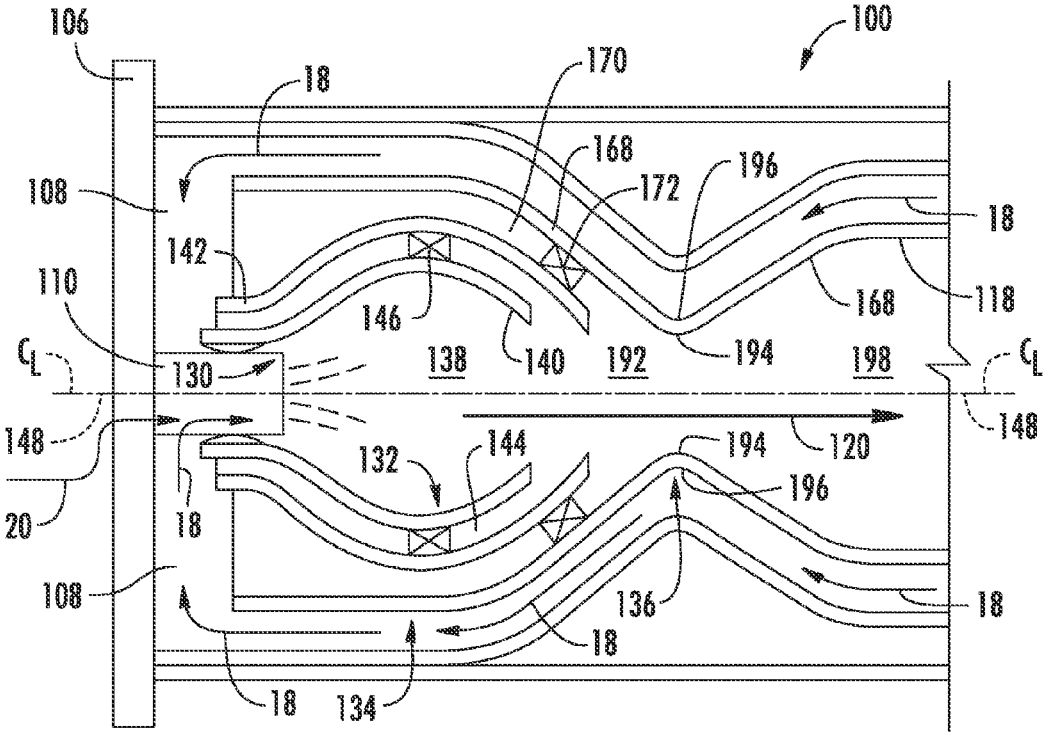
FIG. 3 is an enlarged view of a portion of a combustor as shown in FIG. 2, according to various embodiments of the present invention.

FIG. 3 provides an enlarged view of a portion of the combustor 100 as shown in FIG. 2, according to various embodiments of the present disclosure. As shown in FIG. 3, the fuel nozzle 110 includes a downstream end 130. In particular embodiments, the combustor 100 includes a central swirler 132 that circumferentially surrounds the downstream end 130, thereby allowing the fuel 20 and the working fluid 18 to enter into the rich primary zone 138 of the fuel nozzle 110, an outer swirler 134 that circumferentially surrounds at least a portion of the central swirler 132 and a venturi 136 is disposed downstream from the central swirler 132 and the outer swirler 134.

The central swirler 132 defines a primary or fuel rich combustion zone 138 within the combustor 100 downstream from the fuel nozzle 110. As shown, the central swirler 132 may be generally dome shaped. In particular embodiments, the central swirler 132 comprises of an annular inner liner 140 that circumferentially surrounds the downstream end 130 of the fuel nozzle 110, and an annular intermediate liner 142 that at least partially surrounds the inner liner 140. The inner liner 140 and the intermediate liner 142 are radially separated so as to define a burn out air flow passage 144 therebetween. As shown in FIG. 3, a portion of the compressed working fluid 18 is routed through the burn out air flow passage 144 during operation of the combustor 100.

In particular embodiments, a plurality of turning or swirler vanes 146 extends radially between the inner liner 140 and the intermediate liner 142 within the burn out air flow passage 144. In particular embodiments, the turning vanes 146 are angled or tilted with respect to an axial centerline 148 of the combustor 100 to impart angular swirl or rotation about the axial centerline 148 to the compressed working fluid 18 that is routed through the burn out air flow passage 144.

Figure 4:
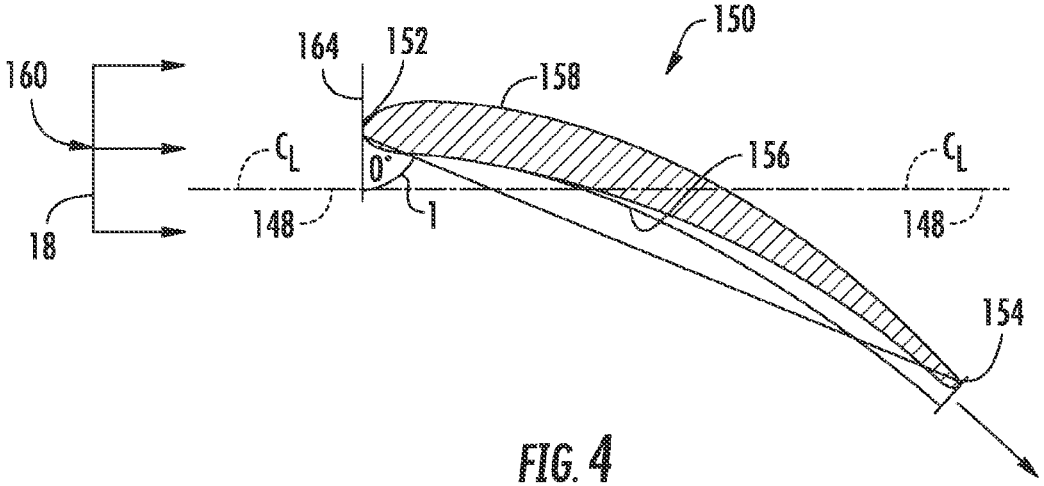
FIG. 4 is a cross section top view of a turning vane of the combustor as shown in FIG. 3, according one embodiment of the present invention.

FIG. 4 provides a cross section top view of an exemplary turning vane 150 of the plurality of turning vanes 142 according to at least one embodiment. As shown, each turning vane 150 may have an airfoil shape or cross section including a leading edge 152, a trailing edge 154, a pressure side 156 and a suction side 158. The leading edge 152 may be substantially oriented to and/or parallel with a direction of flow 160 of the compressed working fluid 18 entering the burn out air flow passage 144 (FIG. 3). The trailing edge 154 is set at a swirl angle 162 which may be measured with respect to a first line 164 that is tangential to the leading edge 152 in plane that is parallel to the axial centerline 148 of the combustor 100 and a second line 166 that extends from the leading edge 152 to the trailing edge 154 within the same plane. As shown, the turning vane(s) 150 may be curved and/or tilted so as to achieve a specific desired amount of angular swirl.

In particular embodiments, as shown in FIG. 3 the outer swirler 134 comprises an outer liner 168 that at least partially circumferentially surrounds the intermediate liner 142. The outer liner 168 and the intermediate liner 142 are radially separated so as to define a cooling air flow passage 170 therebetween. A portion of the compressed working fluid 18 is routed through the cooling air flow passage 170 during operation of the combustor 100. In particular embodiments, a plurality of turning or swirler vanes 172 extends radially between the outer liner 168 and the intermediate liner 142 within the cooling air flow passage 170. In particular embodiments, the turning vanes 172 are angled or tilted with respect to the axial centerline 148 of the combustor to impart angular swirl or rotation about the axial centerline 148 to the compressed working fluid 18 that is routed through the cooling air flow passage 170.

Figure 5:
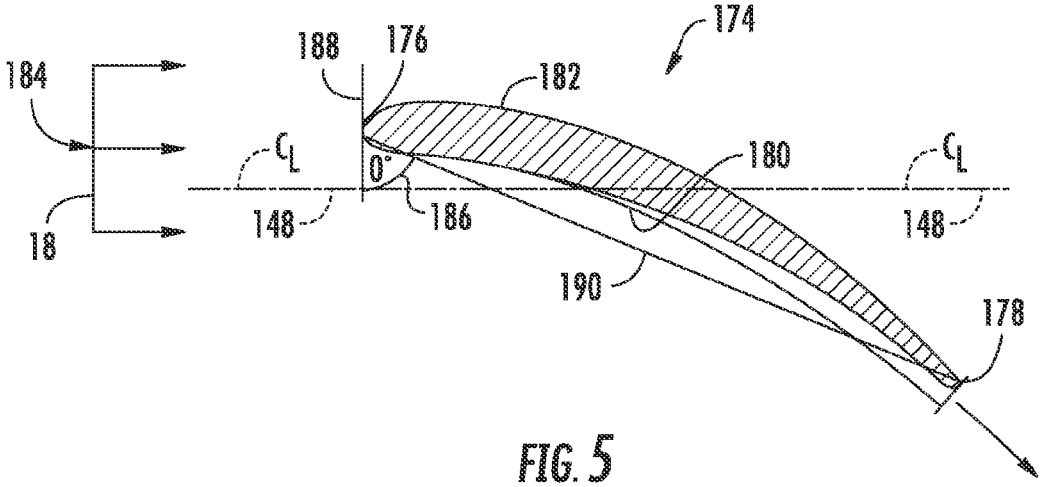
FIG. 5 is a cross section top view of a turning vane of the combustor as shown in FIG. 3, according to one embodiment of the present invention.

FIG. 5 provides a cross section top view of an exemplary turning vane 174 of the plurality of turning vanes 172 according to at least one embodiment. As shown, each turning vane 174 may have an airfoil shape or cross section including a leading edge 176, a trailing edge 178, a pressure side 180 and a suction side 182. The leading edge 176 is oriented into and/or parallel with a direction of flow 184 of the compressed working fluid 18 entering the cooling air flow passage 170 (FIG. 3). The trailing edge 178 is set at a swirl angle 186 which may be measured with respect to a first line 188 that is tangential to the leading edge 176 in plane that is parallel to the axial centerline 148 of the combustor 100 and a second line 190 that extends from the leading edge 176 to the trailing edge 178 within the same plane. As shown, the turning vane(s) 174 may be curved and/or tilted so as to achieve a specific desired amount of angular swirl.

The plurality of turning vanes 146 of the central swirler 132 may be positioned forward, aft or may be axially aligned with the plurality of turning vanes 172 of the outer swirler 134. The turning vanes 146 of the central swirler 132 may be angled to impart angular swirl in one rotational direction and the plurality of turning vanes 172 of the outer swirler 134 may be angled to impart angular swirl in an opposite rotational direction. For example, the central swirler 132 may be angled to impart angular swirl in a clockwise direction while the outer swirler 134 may be angled to impart angular swirl in a counter clockwise rotational direction. Although only one row of the plurality turning vanes 146 and 172 is shown in the central swirler 132 and the outer swirler 134 respectfully, it should be obvious to one or ordinary skill in the art that either or both of the central swirler 132 or the outer swirler 134 may include multiple rows of the turning vanes 146, 172 disposed throughout the central swirler 132 or the outer swirler 134.

Figure 6:
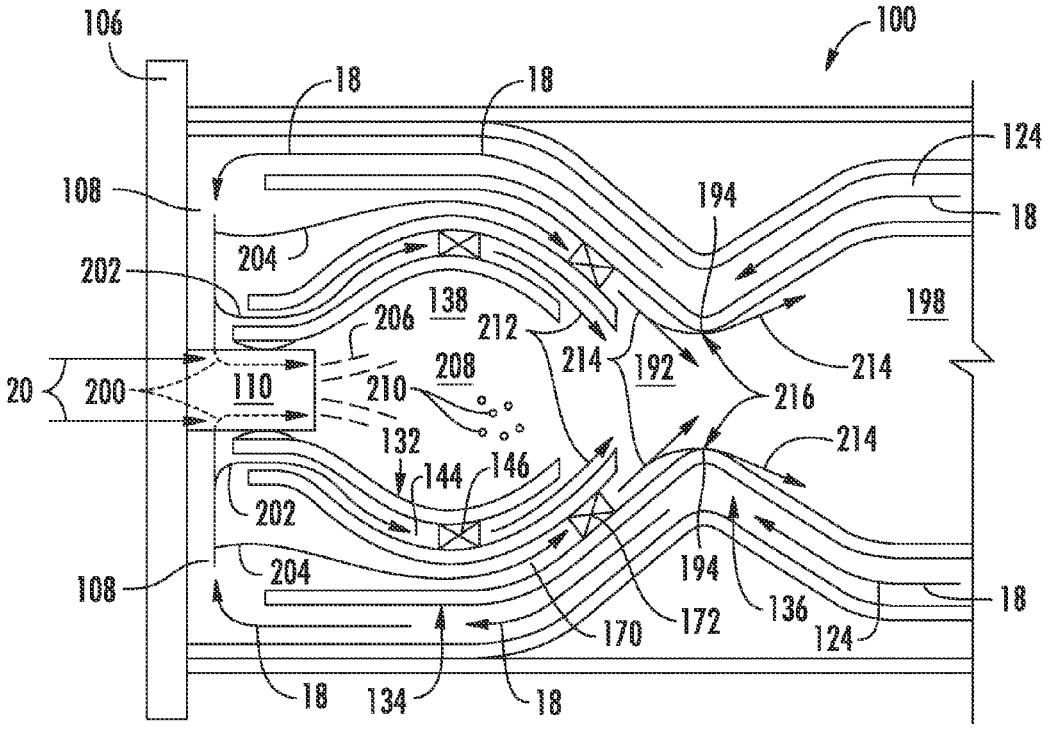
FIG. 6 is an enlarged cross sectional side view of the portion of the combustor shown in FIG. 3, according to one embodiment of the present invention.

FIG. 6 provides an enlarged cross section side view of the combustor 100 as shown in FIG. 3. As shown in FIGS. 3 and 6, the venturi 136 at least partially defines a quick-quench or quick-mix zone 192 within the combustor 100. The venturi 136 may be at least partially formed by a swirling cooling air flow 214 (FIG. 6) that exits the cooling air flow passage 170. In particular embodiments, the venturi 136 is formed by one of the liners or ducts 118 positioned downstream from the primary combustion zone and/or downstream from the central swirler 132 and the outer swirler 134. In one embodiment, the venturi 136 is at least partially defined by the outer liner 168 of the outer swirler 134. The venturi 136 generally includes an inner or hot side surface 194 radially separated from an outer or cold side surface 196. In particular embodiments, the venturi 136 at least partially defines the hot gas path 120 through the combustor 100.

In particular embodiments, the combustor 100 further comprises an expansion or lean burn out zone 198 at or immediately downstream from the venturi 136. The lean burn out zone 198 may be at least partially defined by the outer liner 168 of the outer chamber 134, the venturi 136, and/or one of the liners or ducts 118. The lean burn out zone 198 at least partially defines the hot gas path 120 within the combustor 100.

In operation, as shown in FIG. 6 and at least partially in FIGS. 2, 3, 4 and 5, a portion of the compressed working fluid 18 from the compressor (FIG. 1) is routed through the cooling flow passage 124 towards the head end 108 of the combustor 100. A first portion 200 of the compressed working fluid 18 is routed through the fuel nozzle 110, a second portion 202 of the compressed working fluid 18 is routed through the burn out air flow passage 144 and a third portion 204 of the compressed working fluid 18 is routed through the cooling air flow passage 170.

The first portion 200 of the compressed working fluid 18 is mixed with fuel 20 such as a liquid fuel having elevated levels of fuel bound nitrogen. A fuel-rich fuel and air combustible mixture 206 is injected from the fuel nozzle 110 into the primary combustion zone 138 defined within the central swirler 132. The fuel-rich combustible mixture 206 is partially burned which results in a combustion gas 208 having residual liquid fuel 210. The combustion gas 208 including the residual liquid fuel 210 flows downstream from the primary combustion zone 138 towards the venturi 136. Oxidation of the liquid fuel is minimized by burning the fuel-rich combustible mixture 206 in the primary combustion zone due to a lower combustion temperature and oxidizer concentration. As a result, oxidation of fuel bound nitrogen and N2 to NOx is reduced, thereby enhancing the emissions performance of the combustor 100.

Angular swirl is imparted to the second portion 202 of the compressed working fluid 18 as it flows across the turning vanes 146 within the burn out air flow passage 144, thereby creating a swirling quench air flow 212 downstream from the turning vanes 146. As the swirling quench air flow 212 exits the burn out air flow passage 144, the swirling quench air flow 212 surrounds or swirls around the combustion gas 208 and provides shear to the residual liquid fuel 210 to allow for rapid mixing with the combustion gas 208, thereby allowing for burn out of the residual liquid fuel 210. In addition, the swirling quench air dilutes and/or cools the combustion gas 208 flowing from the primary combustion zone 138 which reduces the temperature of the combustion gas 208 thereby reducing NOx emissions and reducing thermal stresses within the combustor 100.

Angular swirl is also imparted to the third portion 204 of the compressed working fluid 18 as it flows across the turning vanes 172 within the cooling air flow passage 170, thereby creating the swirling cooling air flow 214 downstream from the turning vanes 172. The swirling cooling air flow 214 circumferentially surrounds the combustion gas 208 and the swirling quench air flow 212 as it exits the cooling flow passage 170.

The swirling cooling air flow 214 may be directed such that it swirls in both an axial and radially inward direction. The swirling cooling air flow 214 may be directed to swirl in either a co-swirl or counter swirl direction with respect to the swirling quench air flow 212. In one embodiment, the swirling cooling air flow swirls in a counter swirl direction with respect to the swirling quench air flow 212. In particular embodiments, the swirling cooling air flow 214 forms a cooling boundary layer 216 along the inner surface 194 of the venturi 136 to provide a protective cooling boundary between the combustion gas 208 and the venturi 136. As a result, thermal stresses are significantly reduced at the venturi 136, thereby enhancing the durability of the combustor 100. In addition, a portion of the cooling air flow 214 may provide addition shear and/or compression to the residual liquid fuel 210 thus reducing CO and soot and providing additional dilution and/or cooling of the combustion gas 208, thereby reducing undesirable emissions and reducing buildup of the soot or other particulate matter along the inner surface 196 of the venturi 136. In one embodiment, the swirling cooling air flow 214 at least partially defines the venturi 136. In another embodiment, the swirling cooling air flow 214 may solely define the venturi 136, thereby eliminating the need for a liner or duct.

The venturi 136 allows for more complete mixing of the combustion gas 208 and the quench air flow 212 and allows for a rapid expansion of the combustion gas 208 as it flows from the primary combustion zone 138 into the expansion or lean-burn out 198 portion of the combustor 100. Mixing the quench air flow 212 and the cooling sir flow 214 with the combustion gas 208 dilutes or leans out the remaining unburned fuel, thereby providing a uniform temperature flow field for further combustion downstream in the expansion or lean-burn out zone 198. As a result, peak temperature zones or hot spots are reduced and/or eliminated within the flow field of the combustion gases 208 which results in minimized NOx production.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A combustor for a gas turbine, comprising:

a. fuel nozzle having a downstream end;

b. a central swirler, wherein the central swirler is at least partially defined by an inner liner that surrounds the downstream end of the fuel nozzle, an intermediate linter that surrounds the inner liner and a plurality of turning vanes that extends between the inner liner and the intermediate liner, wherein a downstream trailing end of the inner liner and a downstream trailing end of the intermediate liner converge radially inwardly towards an axial centerline of the combustor;

c. a primary combustion zone defined by the inner liner of the central swirler;

d. an outer swirler, outside of the intermediate liner, that circumferentially surrounds at least a portion of the central swirler;

e. a venturi downstream from the primary combustion zone, the venturi haying an inner surface; and f. wherein the plurality of turning vanes of the central swirler imparts angular swirl to a compressed working fluid to react with a fuel rich mixture from the primary combustion zone and the outer swirler imparts angular swirl to a compressed working fluid to provide a cooling boundary layer along the inner surface of the venturi.

2. The combustor as in claim 1, wherein the venturi defines a quench zone within the combustor to remove heat from a stream of combustion gases flowing from the primary combustion zone.

3. The combustor as in claim 1, wherein the central swirler imparts angular shear with respect to an axial centerline of the combustor to a compressed working fluid to provide rapid vaporization and combustion of residual liquid fuel within the primary combustion zone.

4. The combustor as in claim 1, wherein the outer swirler imparts angular shear with respect to an axial centerline of the combustor to a compressed working fluid to rapidly burn out combustible mixture flowing from the primary combustion zone.

5. The combustor as in claim 1, further comprising an expansion zone downstream from the venturi.

6. The combustor as in claim 1, wherein the inner liner and the intermediate liner are dome shaped.

7. The combustor as in claim 1, wherein the outer swirler is at least partially defined by the intermediate liner, an outer liner that surrounds the intermediate liner and a plurality of turning vanes that extends radially between the intermediate liner and the outer liner.

8. The combustor as in claim 7, wherein the venturi is at least partially defined by the outer liner.

9. A combustor for a gas turbine, comprising:

a. a central swirler comprising an inner liner that defines a primary combustion zone within the combustor, an intermediate circumferentially surrounding and radially spaced from the inner liner and a plurality of turning vanes that extend between the inner liner and the intermediate liner, wherein the turning vanes imparts angular swirl to a working fluid flowing through the central swirler to provide a swirling quench air flow downstream from the primary combustion zone, wherein the inner liner and the intermediate liner are dome shaped, wherein a downstream trailing end of the inner liner and a downstream trailing end of the intermediate liner converge radially inwardly towards an axial centerline of the combustor;

b. an outer swirler, outside of the intermediate liner, that surrounds the swirler and that imparts angular swirl to a working fluid flowing through the outer swirler to provide a swirling cooling air flow that surrounds the swirling quench air flow;

c. a venturi disposed downstream from the primary combustion zone, the venturi being in fluid communication with the central wirier and the outer swirler, the venturi having an inner surface; and d. wherein the outer swirler provides a cooling boundary layer of the swirling cooling air flow along the inner surface of the venturi.

10. The combustor as in claim 9, wherein the venturi defines a quench zone within the combustor to remove heat from a stream of combustion gases flowing from the primary combustion zone.

11. The combustor as in claim 9, wherein the central swirler imparts angular shear with respect to an axial centerline of the combustor to a compressed working fluid to provide rapid vaporization and combustion of residual liquid fuel within the primary combustion zone.

12. The combustor as in claim 9, wherein the outer swirler imparts angular shear with respect to an axial centerline of the combustor to a compressed working fluid to rapidly burn out combustible mixture flowing from the primary combustion zone.

13. The combustor as in claim 9, further comprising an expansion zone downstream from the venturi.

14. The combustor as in claim 9, further comprising an axially extending fuel nozzle having a downstream end, wherein the inner liner of the central swirler surrounds the downstream end of the fuel nozzle.

15. The combustor as in claim 14, wherein the outer swirler is at least partially defined by the intermediate liner, an outer liner that surrounds the intermediate liner and a plurality of turning vanes that extends radially between the intermediate liner and the outer liner.

16. The combustor as in claim 15, wherein the venturi is at least partially defined by the outer liner.

17. A gas turbine, comprising:

a. a compressor, a combustor downstream from the compressor and a turbine disposed downstream from the combustor, the combustor comprising:

i. an end cover coupled to an outer casing that surrounds the combustor;

ii. a fuel nozzle that extends downstream from the end cover, the fuel nozzle having a downstream end;

iii. a central swirler comprising an inner liner that surrounds the downstream end of the fuel nozzle, an intermediate liner circumferentially surrounding and radially spaced from the inner liner and a plurality of turning vanes that extend between the inner liner and the intermediate liner, wherein the turning vanes impart angular swirl to a working fluid flowing through the central swirler to provide a swirling quench air flow downstream from the primary combustion zone, wherein the inner liner and the intermediate liner are dome shaped, wherein a downstream trailing end of the inner liner and a downstream trailing end of the intermediate liner converge radially inwardly towards an axial centerline of the combustor;

iv. an outer swirler, outside of the intermediate liner, that surrounds the central swirler and that imparts angular swirl to a working fluid flowing through the outer swirler to provide a swirling cooling air flow that surrounds the quench air flow; and v. a venturi disposed downstream from the primary combustion zone, the venturi being in fluid communication with the central swirler and the outer swirler;

vi. wherein the outer swirler provides a cooling boundary layer of the swirling cooling air flow along the inner surface of the venturi.

18. The gas turbine as in claim 17, wherein the combustor further comprises an expansion zone downstream from the venturi.

19. The gas turbine as in claim 17, wherein the outer swirler is at least partially defined by the intermediate liner, an outer liner that surrounds the intermediate liner and a plurality of turning vanes that extends radially between the intermediate liner and the outer liner.

* * * * *